US009072343B1

(12) United States Patent
Ogilvie

(10) Patent No.: US 9,072,343 B1
(45) Date of Patent: Jul. 7, 2015

(54) MULTIGRIP TOUCH CLOSURE FASTENERS

(71) Applicant: John W. Ogilvie, Salt Lake City, UT (US)

(72) Inventor: John W. Ogilvie, Salt Lake City, UT (US)

( * ) Notice: Subject to any disclaimer, the term of this patent is extended or adjusted under 35 U.S.C. 154(b) by 0 days.

(21) Appl. No.: 14/146,704

(22) Filed: Jan. 2, 2014

(51) Int. Cl.
*A44B 18/00* (2006.01)
*B65D 63/10* (2006.01)

(52) U.S. Cl.
CPC ..... *A44B 18/0023* (2013.01); *Y10T 24/1498* (2015.01); *Y10T 24/2725* (2015.01); *B65D 63/10* (2013.01); *A44B 18/0065* (2013.01); *Y10T 24/27* (2015.01); *A44B 18/0061* (2013.01); *Y10T 24/2733* (2015.01); *A44B 18/0003* (2013.01); *A44B 18/0019* (2013.01); *Y10T 24/2792* (2015.01); *A44B 18/0038* (2013.01); *A44B 18/0034* (2013.01); *Y10T 24/2708* (2015.01)

(58) Field of Classification Search
CPC ..... A44B 18/0003; A44B 18/0019; A44B 18/0034; A44B 18/0038; A44B 18/0061; A44B 18/0065; B65D 63/10; Y10T 24/27; Y10T 24/1498; Y10T 24/2708; Y10T 24/2725; Y10T 24/2733; Y10T 24/2792
USPC ..... 24/713
See application file for complete search history.

(56) References Cited

U.S. PATENT DOCUMENTS

| | | | | |
|---|---|---|---|---|
| 3,009,235 | A | 11/1961 | de Mestral | |
| 3,138,841 | A | 6/1964 | Naimer | |
| 4,247,967 | A * | 2/1981 | Swinton | 24/713 |
| 4,290,174 | A | 9/1981 | Kalleberg | |
| 4,454,183 | A | 6/1984 | Wollman | |
| 4,761,318 | A | 8/1988 | Ott et al. | |
| 4,775,310 | A | 10/1988 | Fischer | |
| 4,875,259 | A | 10/1989 | Appeldorn | |
| 4,894,060 | A | 1/1990 | Nestegard | |

(Continued)

FOREIGN PATENT DOCUMENTS

| | | |
|---|---|---|
| CN | 201986495 | 9/2011 |
| CN | 102550391 | 7/2012 |

OTHER PUBLICATIONS

"Where can I get 'quiet Velcro'?", retrieved from <<http://askville.amazon.com/quiet-Velcro/AnswerViewer.do?requestId=4494244>>, copyright 2006-2012, 4 pages.

(Continued)

*Primary Examiner* — Robert J Sandy
*Assistant Examiner* — Louis Mercado
(74) *Attorney, Agent, or Firm* — Ogilvie Law Firm

(57) ABSTRACT

Specialized tape and tape-built articles help reduce problems such as load slippage, odd or varying load sizes, or the inconvenience of knots. A touch closure fastening means allows users to releasably fasten together different portions of the article. Example touch closure fastening means include hooks, mushroom heads, loops, a mat, or nanofibers. Some articles include a tape which is laned, striped, staggered, mottled, spiraled around a core, and/or braided; some include multiple tapes braided with one another. Some articles include suture material, polypropylene, nylon, or a para-aramid synthetic fiber in a tape substrate. Some articles include a grip strip to facilitate multigripping—not only does the article releasably fasten to itself, it also restricts movement of a load or other work piece. A grip strip and a tape can be spiraled or braided together. The grip strip has a mechanical indentation grip, or an adhesion grip, for example.

13 Claims, 5 Drawing Sheets

(56) References Cited

U.S. PATENT DOCUMENTS

| | | | | |
|---|---|---|---|---|
| 5,058,247 | A | 10/1991 | Thomas et al. | |
| 5,067,210 | A | 11/1991 | Keyaki | |
| 5,074,013 | A * | 12/1991 | Arnold et al. | 24/713 |
| 5,179,767 | A | 1/1993 | Allan | |
| 5,196,266 | A | 3/1993 | Lu et al. | |
| 5,243,991 | A * | 9/1993 | Marks | 600/499 |
| 5,354,591 | A * | 10/1994 | Ott et al. | 428/99 |
| 5,843,126 | A | 12/1998 | Jameel | |
| 5,867,868 | A * | 2/1999 | Ward | 16/422 |
| 5,902,427 | A | 5/1999 | Zinke et al. | |
| 5,997,981 | A | 12/1999 | McCormack et al. | |
| 6,119,314 | A | 9/2000 | Freed | |
| 6,205,623 | B1 * | 3/2001 | Shepard et al. | 24/30.5 R |
| 6,430,784 | B1 * | 8/2002 | Dudek et al. | 24/306 |
| 6,481,063 | B2 * | 11/2002 | Shepard et al. | 24/30.5 R |
| 7,132,161 | B2 | 11/2006 | Knowles et al. | |
| 7,181,811 | B1 | 2/2007 | Tomanek et al. | |
| 7,651,769 | B2 | 1/2010 | Dubrow | |
| 7,972,616 | B2 | 7/2011 | Dubrow et al. | |
| 8,002,612 | B2 | 8/2011 | Fisher | |
| 8,030,376 | B2 | 10/2011 | Kurz | |
| 8,216,252 | B2 | 7/2012 | Vaughan et al. | |
| 8,375,529 | B1 | 2/2013 | Duffy | |
| 8,397,357 | B1 * | 3/2013 | Madey | 24/712.3 |
| 8,413,306 | B2 * | 4/2013 | Gallant et al. | 24/306 |
| 8,480,943 | B2 | 7/2013 | Duffy | |
| 8,518,517 | B2 * | 8/2013 | Poulakis | 428/100 |
| 8,545,963 | B2 | 10/2013 | Alberding et al. | |
| 8,549,714 | B1 | 10/2013 | Shepard et al. | |
| 8,551,119 | B2 | 10/2013 | Kogiso et al. | |
| 8,601,648 | B2 | 12/2013 | Poulakis | |
| 2002/0037390 | A1 | 3/2002 | Shepard et al. | |
| 2002/0124358 | A1 * | 9/2002 | Dudek et al. | 24/306 |
| 2003/0074768 | A1 * | 4/2003 | Shepard et al. | 24/30.5 R |
| 2003/0150087 | A1 * | 8/2003 | Dieterich | 24/306 |
| 2005/0015938 | A1 * | 1/2005 | Shepard et al. | 24/30.5 R |
| 2009/0241300 | A1 | 10/2009 | Ferguson | |
| 2013/0055882 | A1 | 3/2013 | Egres, Jr. | |
| 2013/0059111 | A1 | 3/2013 | Idrizovic et al. | |
| 2013/0160250 | A1 | 6/2013 | Lecluyse et al. | |
| 2013/0205741 | A1 | 8/2013 | Gilbos et al. | |

OTHER PUBLICATIONS

"Adhesive Backed VELCRO® Brand Fasteners", retrieved from <<http://www.velcro.com>>, no later than Dec. 30, 2013, 10 pages.

"Amazon.com: Expandable Braided Velcro Cable Wrap NIP: Electronics", retrieved from <<http://www.amazon.com/Expandable-Braided-Velcro-Cable-Wrap/dp/B000WLWFM8/ref=cm_cr_pr_product_top, no later than Dec. 30, 2013, 4 pages.

"FASTENation—VELCRO® Brand Adhesive Fasteners", retrieved from <<http://www.fastenation.com>>, no later than Dec. 30, 2013, 2 pages.

"Hook and loop fastener—Wikipedia, the free encyclopedia", retrieved from <<http://en.wikipedia.org/wiki/Hook_and_loop_fastener, Dec. 9, 2013, 3 pages.

"Velcro—Wikipedia, the free encyclopedia", retrieved from <<http://en.wikipedia.org/wiki/Velcro>>, Dec. 10, 2013, 7 pages.

"Kingsmere Crafts", retrieved from <<http://www.kingsmerecrafts.com/page73.html>>, no later than Dec. 30, 2013, 3 pages.

Carole Ann, "What Are the Uses of Velcro", retrieved from <<http://www.ehow.com/about_5261747_uses-velcro.html>>, no later than Dec. 30, 2013, 4 pages.

Dale Wickell, "Best Tie Downs to Secure Your Pickup Truck's Cargo", retrieved from <<http://trucks.about.com/od/drivingadvice/tp/Best-Truck-Tie-Downs.htm>>, no later than Dec. 30, 2013, 4 pages.

"Rope Knots—Best Knots Animated and Illustrated", retrieved from <<http://www.netknots.com/rope_knots>>, no later than Dec. 30, 2013, 6 pages.

Alan Brandon, "Steel 'Velcro' supports 35 metric tons, looks scary", retrieved from <<http://www.gizmag.com/metaklett-steel-velcro/12824/>>, Sep. 14, 2009, 5 pages.

"Vintage Black Lavender Purple Braided Cord Rope Velcro Waist Belt Size s M | eBay", retrieved from <<http://www.ebay.com>>, no later than Dec. 30, 2013, 3 pages.

"Van der Waals force—Wikipedia, the free encyclopedia", retrieved from <<http://en.wikipedia.org/wiki/Van_der_Waals_force>>, Dec. 17, 2013, 6 pages.

"Glue Dots—for those occasions when 'sticky' is a good thing!", retrieved from <<http://www.mailmerry.com/GLUEDOTS.htm>>, Jan. 2, 2014, 2 pages.

"Amazon.com: Velcro Ball and Catch Game: Toys & Games", retrieved from <<http://www.amazon.com/Velcro-Ball-and-Catch-Game/dp/B0012DRDUE>>, no later than Jan. 2, 2014, 4 pages.

Gerard, "What David Letterman's Velcro Suit Stunt Has to Do with Earthquake Preparedness", retrieved from <<http://www.totallyunprepared.com/2013/03 . . . >>, Mar. 27, 2013, 4 pages.

"Adhesive—Wikipedia, the free encyclopedia", retrieved from <<http://en.wikipedia.org/wiki/Adhesive>>, Dec. 18, 2013, 13 pages.

"Suture materials comparison chart—Wikipedia, the free encyclopedia", retrieved from <<http://en.wikipedia.org/wiki/Adhesive>>, Dec. 2013, 4 pages.

"Suture materials. DermNet NZ", retrieved from <<http://www.dermnetnz.org/procedures/sutures.html>>, Dec. 29, 2013, 4 pages.

* cited by examiner

MULTIGRIP TOUCH CLOSURE FASTENERS

BACKGROUND

Fasteners in the broadest sense include nails, screws, bolts, rivets, permanent and releasable adhesives, hook-and-loop materials, zippers, slidingly engaging fasteners, elastics, webs, cinches, ropes and strings and other "cords", wires, buckles, latches, clamps, crimps, plastic wraps, solder, cement, and many other examples. There are many different kinds of fasteners made of many different kinds of materials and designed for use in fastening together many different types of objects in many different situations subject to many different requirements such as permanence, releasability, load-bearing capability, ease of fastening, ease of unfastening, marine or weather or temperature or other environmental factor resistance, cost, ease of manufacturing, color choices, and flexibility, among others.

SUMMARY

Some embodiments are directed to technical problems such as load slippage, odd or varying load sizes, or the inconvenience of tying and/or untying knots. Some embodiments provide an article of manufacture including at least one tape substrate and at least one touch closure fastening means physically connected to the tape substrate. The substrate maybe of fabric, for example, and has at least one side. The substrate has a length-to-width ratio greater than one. The touch closure fastening means serves as a means for releasably touch closure fastening at least one portion of the article to at least one other portion of the article. In some embodiments, the touch closure fastening means includes hooks, mushroom heads, loops, a mat, and/or nanofibers.

In some embodiments, the article includes a tape which in turns includes the tape substrate and the touch closure fastening means, which is formed from the substrate or adhered to the substrate, for example. In some, the tape is laned, striped, staggered, mottled, spiraled around a core, and/or braided; each of these terms has a particular meaning defined in this document. Some embodiments include at least two tapes, which are braided with one another. Some embodiments include suture material in the substrate.

Some embodiments include a grip strip to facilitate multi-gripping—not only does the article releasably fasten to itself, it also restricts movement of a load or other work piece. In some cases, the tape and the grip strip are braided with one another.

Some embodiments of a tape-built article include at least two tapes, with each tape including a tape substrate and a touch closure fastening means. Each tape substrate has at least one side, and in some embodiments each tape substrate has a length-to-width ratio of at least three. Each touch closure fastening means is physically connected to at least one respective tape substrate. In some embodiments, at least one of the tapes has at least two lanes. In some, at least two of the tapes are braided with one another. In some embodiments, each of at least two tapes has a respective touch closure fastening means that is different from the touch closure fastening means of at least one other of the tapes.

Some embodiments include at least one grip strip, and at least one grip strip and at least one of the tapes are spiraled, or braided, or both spiraled and braided with one another. The grip strip has a mechanical indentation grip, or an adhesion grip, for example.

Some embodiments of a tape-built article include at least one tape, which includes a tape substrate and a touch closure fastening means. The tape substrate has at least one side, and the tape substrate has a length-to-width ratio of at least five. The touch closure fastening means is physically connected to the tape substrate, and at least one grip strip is physically connected to the tape.

Some embodiments include a rope containing the tape and the grip strip. In some, the rope or other article has a length of at least three meters and a length-to-width ratio of at least forty, for example. In some, the grip strip comprises an adhesion grip substance, or an abrasive grip substance, for example. Some articles include at least two grip strips. In some, the substrate includes polypropylene, nylon, or a para-aramid synthetic fiber.

Examples are provided herein to help illustrate aspects of the technology, but the examples given within this document do not describe all possible embodiments. Embodiments are not limited to the specific materials, arrangements, ratios, features, approaches, or scenarios provided herein. A given embodiment may include additional or different technical features, and may otherwise depart from the examples provided herein.

Thus, the examples given are merely illustrative. In particular, this Summary is not intended to identify key features or essential features of the claimed subject matter, nor is it intended to be used to limit the scope of the claimed subject matter. Rather, this Summary is provided to introduce—in a simplified form—some technical concepts that are further described below in the Detailed Description. The innovation is defined with claims, and to the extent this Summary conflicts with the claims, the claims should prevail.

DESCRIPTION OF THE DRAWINGS

A more particular description will be given with reference to the attached drawings. These drawings only illustrate selected aspects and thus do not fully determine coverage or scope.

DETAILED DESCRIPTION

Overview

Figure 1:
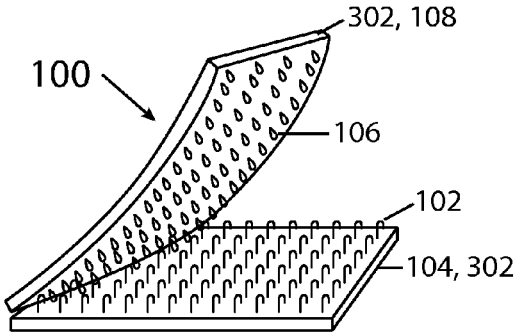
FIG. 1 is a perspective view illustrating a hook and loop fastener mechanism suitable for use in some embodiments.

Innovative embodiments presented herein include, for example, new touch closure fastener articles which facilitate new and/or better usage of such familiar fastener mechanisms. We therefore begin by considering some of the touch closure fasteners which can be used as raw material when implementing embodiments described herein.

Many touch closure fastener mechanisms have been known for years. For example, Swiss engineer George de Mestral invented a hook and loop fastener mechanism in 1948. Many variations on the hook and loop fastener mechanism are now widely used, including variations in products commercially available under brand names such as VELCRO® (mark of Velcro Industries, B.V.) or DURAGRIP® (mark of Fastech of Jacksonville, Inc.). Other types of mechanical fasteners are also known, such as slidingly engaging fasteners, other mushroom head closures, releasably adhesive nanofiber surfaces, so-called Metaklett fasteners (from the German "Metall" meaning metal plus "Klettband" meaning hook-and-pile tape), and many others. Some touch closure fasteners utilize mechanical engagement, e.g., a hook partially passed through a loop, a hook partially tangled in a mat, a hook partially passed through an orifice, or mutually engaged mushroom head undersides. Other touch closure fasteners utilize friction, magnetism, or Van der Waals force to releasably hold together two surfaces. These mechanical and other fastening means discussed herein as raw materials for embodiments are collectively referred to herein as "touch closure fastening means" and are referred to herein in smaller groups as "mechanical fastening means", "frictional fastening means", "magnetic fastening means", "Van der Waals fastening means", "nanofiber fastening means", "mushroom head fastening means" (including slidingly engaging fasteners and other shapes), and so on.

Some touch closure fasteners and/or variations on them are illustrated in FIGS. 1 through 6, and/or in figures of patent documents which are incorporated herein by reference. Each Figure shows a top layer and a bottom layer of a fastener sample; one of skill will understand that additional layers could also be present in samples that are not explicitly depicted here. Also, one of skill will understand that a layer including hooks, mushroom heads, microfibers, nanofibers, and/or other projections can often be combined with a layer including loops, a mat, a Van der Waals surface, and/or orifices, to thereby form a working touch closure fastener means, regardless of whether those two particular layers are explicitly depicted next to each other in one of the Figures.

Each of FIGS. 1 through 6 can be viewed in two different ways. First, they illustrate close-up views of fastener means which (with the possible exception of FIG. 3's symmetric variation noted below) are familiar in the context of fastener strips, fastener coins, and fastener sheets. That is, under a first view the FIGS. 1, 2, 4, 5, and 6 depict small samples that were snipped from familiar fasteners already known to one of skill in the art.

However, upon full reading and comprehension of the present disclosure, it will also be appreciated that these figures are not strictly limited to what is already known, and that it would therefore be misleading to label them as mere prior art. Under a second view the FIGS. 1 through 6 depict small samples snipped from article embodiments presented herein. These article of manufacture embodiments are not the familiar fastener strips, coins or sheets, but instead provide users with variations that have been created by blending, laning, striping, staggering, mottling, braiding, spiraling, and/or multigripping raw fastening material according to the teachings herein. Each of the terms "blending", "laning", "striping", "staggering", "mottling", "braiding", "spiraling", and "multigripping" has a special meaning defined herein using examples set forth in the text and Figures.

FIG. 1 shows a hook and loop fastener sample 100 resembling a fastener described for example in U.S. Pat. No. 3,009,235 to George de Mestral. Hooks 102 attached to a hook substrate 104 releasably engage loops 106 which are attached to a loop substrate 108. Mestral deserves a place of particular respect as a pioneering inventor whose work has inspired many additional innovations and made the world a better place for many people.

Figure 2:
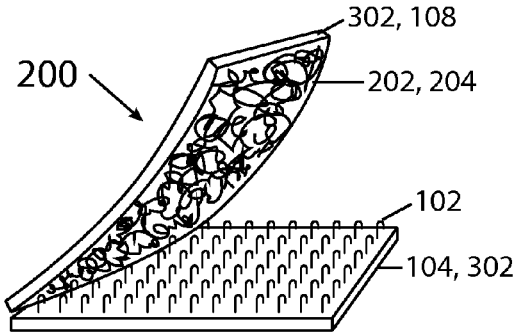
FIG. 2 is a perspective view illustrating a hook and mat fastener mechanism suitable for use in some embodiments.

FIG. 2 shows a hook and loop fastener sample 200 resembling fasteners described for example in U.S. Pat. No. 5,997,981 to McCormack et al., U.S. Pat. No. 4,761,318 to Ott et al., or US Patent Application Publication No. 2002/0037390 of Shepard et al. Hooks 102 attached to hook substrate 104 releasably engage threads 202 of a fibrous mat 204 which is attached to loop substrate 108.

Figure 3:
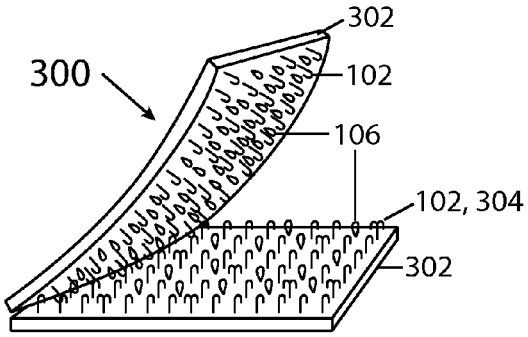
FIG. 3 is a perspective view illustrating a blended hook and loop fastener mechanism suitable for use in some embodiments.

FIG. 3 illustrates two independent but combinable variations. One variation takes the form of a fastener sample 300 in which blended hooks 102 and loops 106 are used. As a result of blending, both hooks and loops are attached to each instance of a substrate 302, and any given small area of the blended material includes both hooks 102 and loops 106 (and/or mat 204, in a variation). At least some of the blended hooks 102 of each instance of the substrate 302 releasably engage at least some of the blended loops 106 which are attached to the other instance of the substrate 302. The substrate 302 instances may be made of the same or different material as one another, such as nylon, plastic, or any of the other materials suitable for use in substrates 104, 108. FIG. 3 also shows a double-pronged hook 304 variation, resembling hooks described for example in U.S. Pat. No. 4,775,310 to Fischer. The double-pronged hook and the blending of hooks and loops/mat are independent combinable variations, so a given article may use double-pronged hooks without blending, or use blending without double-pronged hooks, or use both double-pronged hooks and the blending of hooks and loops and/or mat.

Figure 4:
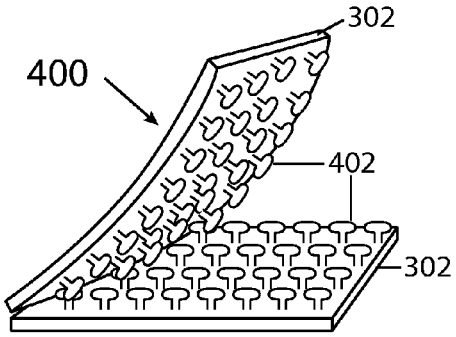
FIG. 4 is a perspective view illustrating a mushroom head fastener mechanism suitable for use in some embodiments.
Figure 6:
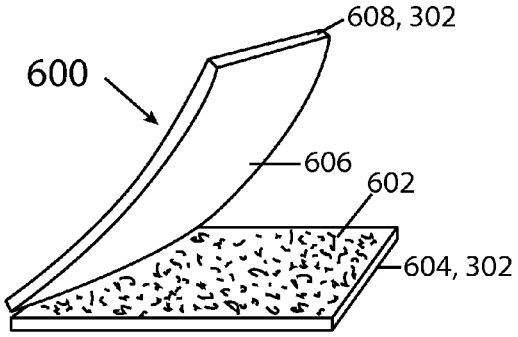
FIG. 6 is a perspective view illustrating a nanofiber fastener mechanism suitable for use in some embodiments.
Figure 7:
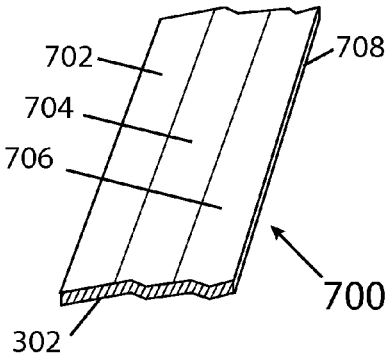
FIG. 7 is a front view illustrating a laned section of a tape according to some embodiments.

FIG. 4 illustrates a fastener sample 400 which resembles mushroom head, slidingly engaging, and/or other hermaphroditic (e.g. symmetric) fasteners that are described for example in U.S. Pat. No. 7,181,811 to Tomanek et al. FIGS. 1a-1f and accompanying text, U.S. Pat. No. 5,902,427 to Zinke et al. FIG. 7 and accompanying text, U.S. Pat. No. 4,894,060 to Nestegard, U.S. Pat. No. 5,067,210 to Kayaki, U.S. Pat. No. 4,290,174 to Kalleberg, U.S. Pat. No. 8,480,943 to Duffy, U.S. Pat. No. 8,375,529 to Duffy, or U.S. Pat. No. 8,601,648 to Poulakis. Heads 402 attached to a substrate 302 releasably interlock with opposing heads 402 which are attached to another substrate 302 that is made of a same or different material as the first substrate. Some fasteners combine mushroom heads 402 with a fibrous mat 204, as described for example in U.S. Pat. No. 5,902,427 to Zinke et al. FIG. 6 and accompanying text, U.S. Pat. No. 4,454,183 to Wollman FIG. 5 and accompanying text, or U.S. Pat. No. 3,138,841 to Naimer FIG. 7 and accompanying text.

Figure 5:
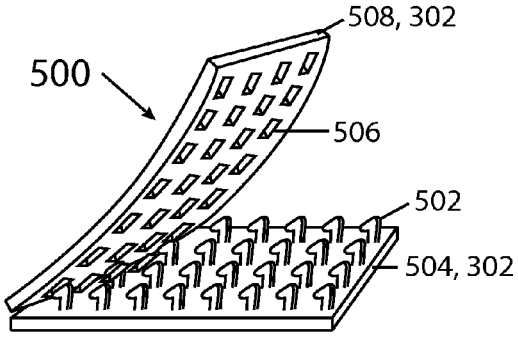
FIG. 5 is a perspective view illustrating a hook and orifice fastener mechanism suitable for use in some embodiments.

FIG. 5 shows a hook and hole fastener sample 500 resembling a fastener described for example in U.S. Pat. No. 5,179,767 to Allan. Hooks 502 attached to a hook substrate 504 releasably engage holes (a.k.a. orifices or openings) 506 which are formed in a hole substrate 508. A similar use of orifices is made in Metaklett fasteners.

FIG. 6 shows a nanofiber fastener sample 600 resembling a fastener described for example in U.S. Pat. No. 7,651,769 to Dubrow. Nanofibers 602 attached to a nanofiber substrate 604 releasably contact a surface 606 of an adhered material 608, by exploiting van der Waals force, for example. Other nanofiber fasteners are described for example in U.S. Pat. No. 7,181,811 to Tomanek et al. FIGS. 3a-4b and accompanying text, U.S. Pat. No. 7,132,161 to Knowles et al., and U.S. Pat. No. 7,972,616 to Dubrow et al. Nanofiber hooks and microfiber hooks may be shaped like candy canes, spirals, partial spirals, or partial arcs, for example. Tomanek discusses a microfastening system employing a plurality of mating nanoscale fastening elements, and a method of manufacturing a microfastening system. The mating nanoscale fastening elements are formed by functionalizing nanotubes having an ordered array of hexagons with pentagons and heptagons at particular heterojunctions.

Other touch closure fasteners are illustrated and otherwise described, for example, in U.S. Pat. No. 5,196,266 to Lu et al., and U.S. Pat. No. 4,875,259 to Appledorn. Lu discusses a reclosable mechanical fastener comprising a fastening component having a surface structure by which two such fastening components can become releasably attached. The fastening component is a composite of a tough substrate and a fastening layer that forms said surface structure, which fastening layer is formed from a cured oligomeric resin composition having one or more like or different hard segments, one or more like or different soft segments, and one or more like or different monovalent moieties containing a radiation-sensitive, addition-polymerizable, function group. Appledorn discusses an intermeshable article useful for purposes such as fastening, e.g., closing, coupling and connecting. The article includes a member which has at least one major surface which is a structured surface. The structured surface is made up of a plurality of elements. Each element has at least one side inclined relative to the plane of the member at an angle sufficient to form a taper. Thus, each element may mesh with at least one corresponding element when brought into contact therewith and adhere thereto at least partially because of the frictional force of adherence of the contacting sides. The corresponding element may be the article itself, another similar article or a dissimilar article, such as for example a container having a correspondingly shaped structured surface. In one configuration, the elements are arranged side by side to form a plurality of linear ridges and grooves whereby the sides of adjacent elements form the sides of each groove.

Touch closure fasteners are made from materials which include, for example, nylon, polyester, thermoplastic resin, synthetic resinous fluorine-containing polymers, polytetrafluoroethylene, glass, metal, plastic, textiles, rubbers, nanofibers (which can optionally comprise such materials as, e.g., silicon, glass, quartz, plastic, metal, polymers, TiO, ZnO, ZnS, ZnSe, ZnTe, CdS, CdSe, CdTe, HgS, HgSe, HgTe, MgS, MgSe, MgTe, CaS, CaSe, CaTe, SrS, SrSe, SrTe, BaS, BaSe, BaTe, GaN, GaP, GaAs, GaSb, InN, InP, InAs, InSb, PbS, PbSe, PbTe, AlS, AlP, AlSb, SiOI, Si02, silicon carbide, silicon nitride, polyacrylonitrile, polyetherketone, polyimide, an aromatic polymer, or an aliphatic polymer), a film laminated with an amorphous polymer layer to a prebonded nonwoven web, needle-punched staple fibers to which a foamed acrylic binder has been applied, woven or non-woven fibers, films, Kraft paper, thermoplastic material, ceramics, ultraviolet radiation-curable organic oligomeric resin, and/or carbon nanotubes. Manufacturing processes employed include molding, curing, weaving, cutting, shearing, machining, forming, nanotube functionalizing, growing or depositing nanofibers, heating, and bonding, for example. Tapes taught herein may also be treated with fire retardant, moisture-resistant, corrosion-resistant, waterproof, and/or other sealants, dyes, nanomaterial coatings, or chemical treatments.

To the full extent permitted by applicable laws of the pertinent jurisdiction in which this disclosure document is examined, each of the following US patent documents is incorporated herein to the full extent of its subject matter specifically cited herein and in any case as to its description of fasteners (a.k.a., closures, adhesives, etc.), their manufacture, and their uses: U.S. Pat. Nos. 3,009,235, 3,138,841, 4,290,174, 4,454,183, 4,761,318, 4,775,310, 4,875,259, 4,894,060, 5,067,210, 5,058,247, 5,179,767, 5,196,266, 5,902,427, 5,997,981, 7,132,161, 7,181,811, 7,651,769, 7,972,616, 8,375,529, 8,480,943, 8,549,714, 8,601,648, and 2002/0037390.

Many patent documents incorporated herein by reference describe some particular fastening means, some particular methods for manufacturing fasteners and some particular uses for fasteners. Incorporated particularities are interesting, but the present disclosure would not be crippled by non-incorporation (exclusion) of the listed patent documents. By way of analogy, a modern chemical technology patent need not describe how to obtain basic chemical elements, a modern mechanical technology patent need not describe how to make basic components such as screws or springs, and a modern computing technology patent need not describe how to make semiconductor chips or wires or displays, because in each case these items are readily available as raw materials with which to innovate. Similarly, the present disclosure need not describe in great detail how to make hooks, how to make loops, how to make mushroom heads, or how to make nanofibers, for example, because manufacturing methods capable of producing samples like those depicted in FIGS. 1, 2, 4, 5, and 6 are well understood today. One can readily obtain materials having depicted sample fastening means, and then use them according to the teachings herein as raw materials to produce innovative articles through laning, striping, staggering, braiding, spiraling, and/or multigripping.

The technical character of embodiments described herein will be apparent to one of ordinary skill in the art, and will also be apparent in several ways to a wide range of attentive readers. Some embodiments address technical problems such as those evident in or created by work piece slippage, load shifting, odd or varying load sizes, knot complexity, and knot bulk. Some embodiments include technical adaptations such as fasteners configured by blending, laning, striping, staggering, braiding, spiraling, and/or multigripping. Some embodiments modify technical functionality of fastener tape by blending, laning, striping, staggering, and/or multigripping based on technical considerations such as whether a load can be dented or scratched or punctured to be better kept in place, whether load size is predictable, and whether environmental conditions contraindicate use of metal fastener components. Technical advantages of some embodiments include improved usability, increased reliability, lower slippage rate, simplified lashing and unlashing, reduced fastening hardware requirements, faster fastening and unfastening, lower inventory requirements, and smaller device space required.

Reference will now be made to exemplary embodiments such as those illustrated in the drawings, and specific language will be used herein to describe the same. But alterations and further modifications of the features illustrated herein, and additional technical applications of the abstract principles illustrated by particular embodiments herein, which would occur to one skilled in the relevant art(s) and having possession of this disclosure, should be considered within the scope of the claims.

The meaning of terms is clarified in this disclosure, so the claims should be read with careful attention to these clarifications. Specific examples are given, but those of skill in the relevant art(s) will understand that other examples may also fall within the meaning of the terms used, and within the scope of one or more claims. Terms do not necessarily have the same meaning here that they have in general usage (particularly in non-technical usage), or in the usage of a particular industry, or in a particular dictionary or set of dictionaries. Reference numerals may be used with various phrasings, to help show the breadth of a term. Omission of a reference numeral from a given piece of text does not necessarily mean that the content of a Figure is not being discussed by the text. The inventor asserts and exercises his right to his own lexicography. Quoted terms are defined explicitly, but quotation marks are not used when a term is defined implicitly. Terms may be defined, either explicitly or implicitly, here in the Detailed Description and/or elsewhere in the application file.

As used herein, "include" allows additional elements (i.e., includes means comprises) unless otherwise stated. "Consists of" means consists essentially of, or consists entirely of. X consists essentially of Y when the non-Y part of X, if any, can be freely altered, removed, and/or added without altering the functionality of claimed embodiments so far as a claim in question is concerned.

Throughout this document, use of the optional plural "(s)", "(es)", or "(ies)" means that one or more of the indicated feature is present. For example, "grip(s)" means "one or more grips" or equivalently "at least one grip".

As used herein "blending" or "blended" or "blend" means that both hooks/mushrooms and loops/mat are attached to each instance of a substrate of a fastener material, and any given 0.5 by 0.5 cm or larger surface area of the blended material includes hooks and/or mushroom heads and also includes loops and/or mat. Moreover, in operation of a touch closure fastener produced by blending, at least some of the blended hooks and/or mushroom heads of each instance of the substrate releasably engage at least some of the blended loops and/or mat attached to the other instance of the substrate. Hooks may be shaped like candy canes, like partial coils, like duck head profiles, or like a portion of an arch, for example. In blended embodiments, as in other embodiments, the ratio of hooks to loops (or hook area to mat area, for example) is not necessarily 1:1.

"Microblending" or "microblended" or "microblend" means the same thing as "blending" or "blended" or "blend", except that the size requirement is 0.05 by 0.05 cm rather than 0.5 by 0.5 cm.

"Macroblending" or "macroblended" or "macroblend" means the same thing as "blending" or "blended" or "blend", except that the size requirement is 1.5 by 1.5 cm rather than 0.5 by 0.5 cm.

Some embodiments do not qualify as macroblended but are better described as "mottled" (with "mottling", in a "mottle" arrangement) than as having lanes. For example, in some mottled embodiments the various touch closure fastening means are arranged in a checkerboard pattern, or arranged in a random or semi-random tiled pattern.

Figure 15:
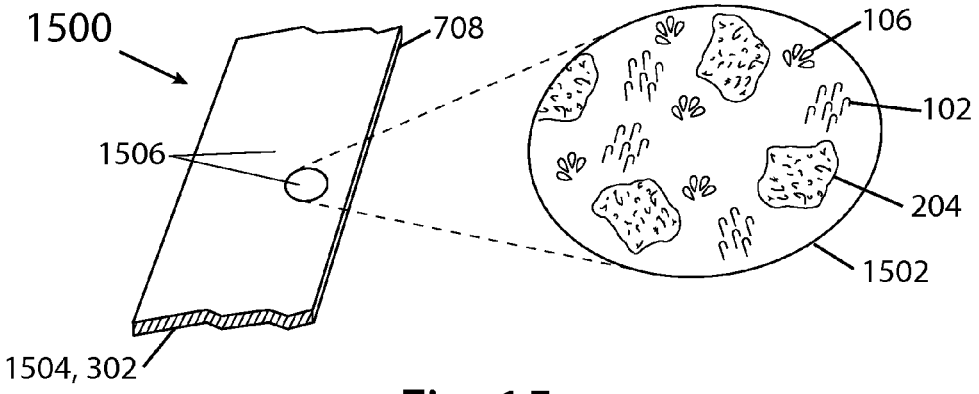
FIG. 15 is a front view including a magnified area illustrating a section of a tape in some embodiments that have a blended fastening portion.

FIG. 3 shows an example with two substrates 302, each substrate bearing a blended portion that includes hooks and loops. FIG. 15 shows an example with a single substrate 1504 of a section 1500 of a tape 708 that bears a blended portion 1506. As shown in magnified region 1502, the blended portion 1506 in this example includes hooks 102, loops 106 and mat 204 components. In double substrate embodiments consistent with FIG. 3, each substrate may be fastened to at least the other substrate by closure of the blended touch closure fastening means. In some double substrate embodiments consistent with FIG. 3, one or both substrates may also be fastened to itself at two locations by closure of the blended touch closure fastening means. In single substrate embodiments like those illustrated in FIG. 15, the single substrate may be fastened to itself at two or more locations by closure of the blended touch closure fastening means.

As used herein, "tape" means an article or a portion of an article which (a) has at least one side, (b) if laid on a flat surface would have a length-to-width ratio of at least four unless otherwise expressly stated, i.e., would be at least four times as long at its maximum length as it is wide at its maximum width unless otherwise expressly stated, and (c) includes a touch closure fastening means extending from, formed from, integral with, and/or adhered to, at least one of its sides. Other length-to-width ratios which may be expressly stated include three, two, five, seven, ten, twenty, thirty, forty, and fifty.

As used herein, "touch closure fastening means layer" means a hook layer, a loop layer, a mat layer, a blended hook and loop layer, a blended hook and mat layer, a mushroom head layer, an orifice layer, a Van der Waals layer, a microfiber layer, a nanofiber layer, or another interfacing portion of a touch closure fastening means. FIG. 1 shows an example of a loop layer and an example of a hook layer. FIG. 2 shows an example of a mat layer and an example of a hook layer. FIG. 3 shows two blended hook and loop layers. FIG. 4 shows two mushroom head layers. FIG. 5 shows an example of an orifice layer and an example of a hook layer. FIG. 6 shows an example of a Van der Waals layer and an example of a nanofiber layer.

As used herein, "grip" or "grip layer" or "grip substance" refers to material which (a) is not a touch closure fastening means layer, and (b) when placed adjacent to a work piece or other item tends to reduce movement of the item through friction, mechanical indentation, and/or adhesion. Some examples of mechanical indentation grip substances are grits used on sandpaper or used by mechanical sanders or grinders, spikes, and teeth. Some examples of frictional grip substances are rubber and antiskid or antislip plastic or composite materials. Some examples of adhesion grip substances are removable glues, gummy materials, and tacky materials.

As used herein "laning" or "laned" or "lane" refers to a side of a tape (as defined above), in which the tape side is divided longitudinally, i.e., parallel to the long axis of the tape, into at least two regions referred to herein as "lanes". Each of the pertinent lanes includes a touch closure fastening means layer extending from, formed from, integral with, and/or adhered to, the region of the tape side which lies within the lane, and at least two different touch closure fastening means layers are present. For example, one lane may include hooks while another lane of the same side of the same tape includes loops, or one lane may include mushroom heads while another lane of the same side of the same tape includes a mat. Either or both sides of the tape may be laned. A laned side may have two, three, or more lanes. Lanes may be different widths. Lane edges need not be perfectly straight, but are generally longitudinal. A given touch closure fastening means layer can be used in only a single lane of a tape side, or it may be used in more than one lane of a given tape side. Not every lane need include a touch closure fastening means layer, but at least two different touch closure fastening means layers will be present when the lanes of a given side are considered as a group; a tape having only hooks on one side and having only loops on the other side, for example, is not laned.

Figure 8:
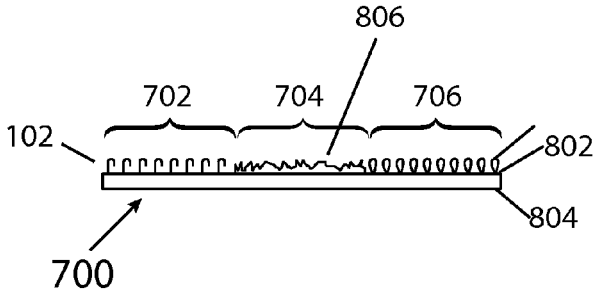
FIG. 8 is a cross sectional view illustrating one embodiment of the laning shown in FIG. 7.

FIGS. 7 through 10 show some of the many possible examples of laning. In FIG. 7, a laned section 700 of a tape 708 has three lanes 702, 704, and 706. In FIG. 8, a cross sectional view of one embodiment of the laning used in FIG. 7 is given, in which lane 702 includes a hook layer and lane 706 includes a loop layer. Other embodiments are also consistent with FIG. 7. Lane 704 in this FIG. 8 example includes an abrasive grit mechanical indentation grip substance 806. In this example, one side 802 of the tape section 700 is laned, and the other side 804 of the tape section 700 is not laned. In other examples, other grip substances are used, and in still other examples, no grip substance is used.

Figure 16:
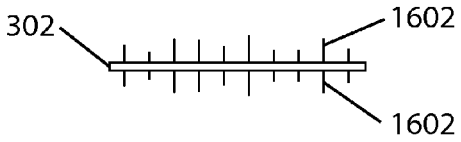
FIG. 16 is a cross sectional view illustrating embodiments of a tape combined with a mechanical indentation grip.
Figure 17:
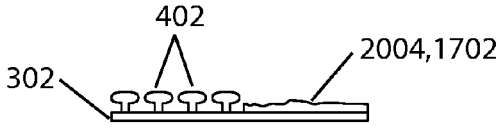
FIG. 17 is a cross sectional view illustrating embodiments of a tape combined with an adhesion grip.

As further illustration of grips, cross-sectional view FIG. 16 shows spikes 1602 extending from a substrate 302; spikes are a mechanical indentation grip. Cross-sectional view FIG. 17 shows mushroom heads 402 extending from a substrate 302, with an adjacent lane of a tacky non-reactive adhesive 1702 grip substance. An adhesive grip substance may include, for example, removable adhesives, removable pressure-sensitive adhesive(s), low adhesion contact adhesive(s) of the kinds used on Post-It® brand note pads or Beautone® brand note pads to removably secure a stack of sheets, and/or removable contact adhesive of the kind used in Glue Dots® brand products for affixing a removable card or plastic stock to a mailing piece, for example. Post-It® is a mark of 3M Company Corporation, Beautone® is a mark of Yuen Foong Paper Co. Ltd., and Glue Dots® is a mark of Glue Dots International, LLC.

Figure 9:
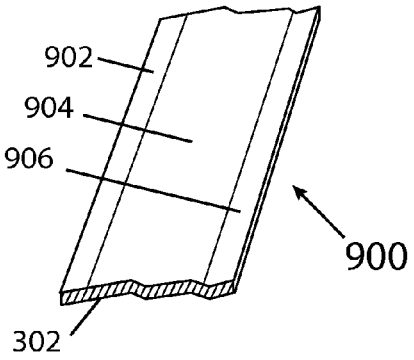
FIGS. 9 and 10 are each a front view illustrating a differently laned section of tape in some embodiments.

FIG. 9 shows a laned section 900 of tape having three lanes 902, 904, 906 of two different widths. In some other three-lane examples three different lane widths are used, and in some, such as FIG. 7, each lane has the same width.

Figure 10:
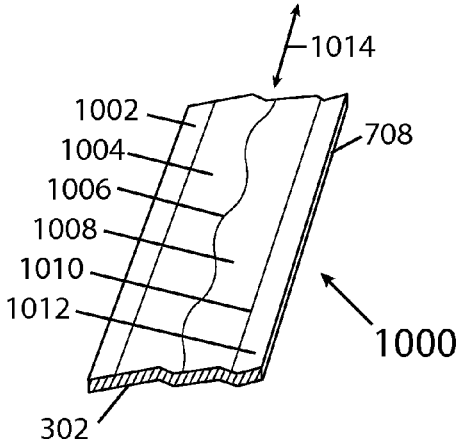

FIG. 10 shows a laned section 1000 of tape having four lanes 1002, 1004, 1008, and 1012. In this example a lane border 1010 is generally straight, whereas another lane border 1006 is not generally straight but is nonetheless easily perceived by even a casual observer as being generally parallel to the longitudinal axis 1014 of the tape 708. In this example the non-straight border is continuous and sinusoidal, but in other embodiments a sawtooth, swirl, arcuate, crenellated, punctuated, jagged, and/or other non-straight yet longitudinal border is used.

As a further example, it will be understood that a ball whose exterior has only a mat is not laned, a target which has only hooks is not laned, and the ball-plus-target combination is likewise not laned, because in this case no single side bears multiple different touch closure fastening means layers. Similarly, a human-wearable suit which has only loops is not laned, a wall-mounted sheet on which a jumper wearing the suit can land and stick is not laned, and the suit-plus-sheet combination is likewise not laned, again because no single side bears multiple different touch closure fastening means layers.

As used herein "striping" or "striped" or "stripe" refers to a side of a tape (as defined above), in which the tape side would be laned if rotated relative to its longitudinal axis while maintaining the position of the touch closure fastening means layers, and resized to fit the tape's size. Alternatively, in a computer graphics model of the tape, the stripes could be rotated as a group to bring them into parallel alignment with the longitudinal axis of the tape section. For convenience, striping can be thought of as a rotated and possibly enlarged or reduced version of laning.

Figure 11:
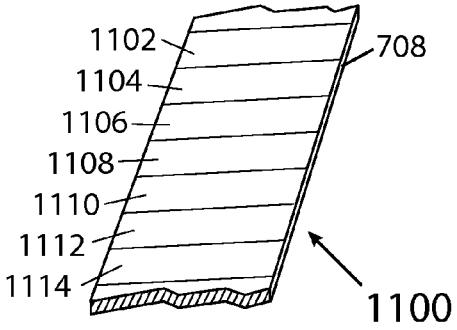
FIGS. 11 and 12 are each a front view illustrating a striped section of tape in some embodiments.
Figure 12:
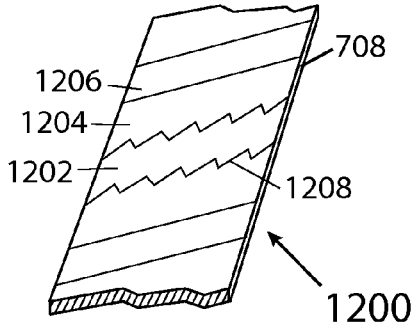

FIGS. 11 and 12 show some of the many possible examples of striping. In FIG. 11, a striped section 1100 of a tape 708 has stripes 1102 through 1114. The stripes in this example include two or more touch closure fastening means layers, and include zero or more grip substances. If rotated one quarter turn, reduced in width to collectively match the tape width, and elongated, the stripes would become lanes. FIG. 12 shows a striped section 1200 of a tape 708 with stripes 1202, 1204, and 1206, in which stripe border 1208 is not straight but rather has a sawtooth form. The variations noted above for lanes generally, and for lane borders in particular, also apply to stripes and stripe borders.

As used herein "staggering" or "staggered" or "stagger" refers to a side of a tape (as defined above), in which lane segments are positioned with the end of a given lane segment located partway along an adjacent lane segment. Staggered lane segments are thus reminiscent of brick arrangements in brick walls; bricks are often laid with the end of one brick located partway along an adjacent brick.

Figure 13:
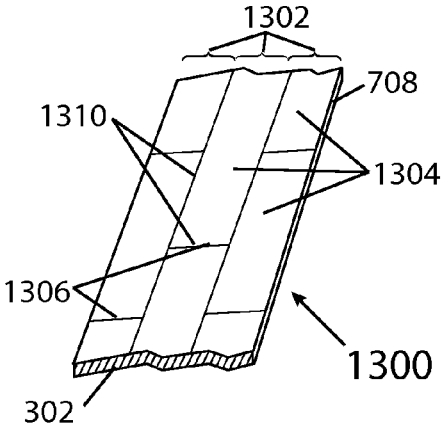
FIG. 13 is a front view illustrating a staggered section of a tape according to some embodiments.

FIG. 13 shows one of the many possible examples of staggering. A staggered section 1300 of a tape 708 has staggers 1304 arranged in lanes 1302. In this example there are three lanes of equal width, each stagger has the same length, each stagger end 1306 lies near a midpoint of the length of an adjacent stagger, and the stagger borders 1310 are straight line segments. In other embodiment examples, however, one or more of these characteristics differs, e.g., an embodiment may have two or more lanes, lanes of two or more widths, staggers of two or more different lengths, stagger ends lying distant from adjacent stagger midpoints as well as unaligned with adjacent stagger ends, and non-straight borders as shown and/or discussed for instance in connection with FIGS. 10, 12, and 14.

Moreover, the order in which touch closure fastening means layers appear in staggers as one traverses a lane may be regular or randomized, an embodiment may include grip substances in zero or more staggers, and the touch closure fastening means layer and/or grip substance within a stagger may fill all or only a substantial portion (namely, at least three-quarters) of the area of a stagger, in a particular embodiment. In some embodiments, for example, touch closure fastening means layers and in some cases a grip substance appear in the staggers of a lane in at least one of the following periodic sequences, or in the reverse order of at least one of these sequences:

hook, mat, grip, hook, mat, grip, hook, mat, grip, . . .

hook, loop, grip, hook, loop, grip, hook, loop, grip, . . .

hook, mat, hook, mat, grip, hook, mat, hook, mat, grip, . . .

hook, loop, hook, loop, grip, hook, loop, hook, loop, grip, . . .

hook, mat, hook, mat, hook, mat, . . .

hook, loop, hook, loop, hook, loop, . . .

hook, grip, mat, grip, hook, grip, mat, grip, hook, grip, mat, grip, . . .

hook, grip, mat, grip, hook, grip, loop, grip, hook, grip, mat, grip, . . .

hook, mat, grip, hook, loop, grip, hook, mat, grip, hook, loop, grip, . . .

mushroom head, grip, mushroom head, grip, mushroom head, grip, . . .

blend, grip, blend, grip, blend, grip, . . .

mushroom head, grip, blend, grip, mushroom head, grip, blend, grip, . . .

Figure 14:
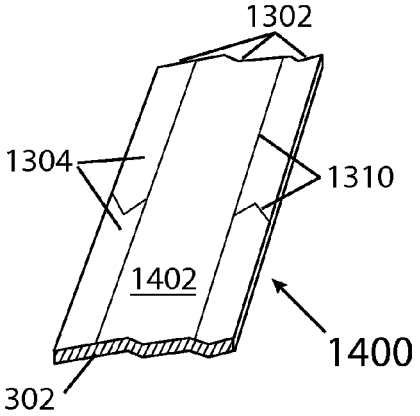
FIG. 14 is a front view illustrating a section of a tape in some embodiments having staggers in two lanes and having a third lane that is continuous rather than staggered.

As another example, FIG. 14 shows a section 1400 of a tape 708 which has staggers 1304 in two lanes 1302 and a third lane that is continuous rather than staggered. In this example the staggered lanes are on each side of the continuous lane, and the continuous lane bears a grip 1402, but other spatial arrangements of staggers occur in other embodiments, and other embodiments do not necessarily include any grips 1402.

The foregoing examples focus largely on tapes, but some embodiments include spatial arrangements other than simple flat tapes. For example, long narrow tapes may be braided or spiraled, as shown in FIGS. 18 through 22, to produce new articles. Within such embodiments, each individual tape has two sides, and the article overall has at least one side bearing at least one touch closure fastening means and—in some embodiments—also bearing at least one grip.

As used herein "spiraling" or "spiraled" or "spiral" refers to an article (a.k.a. device) or portion thereof having at least one length of tape (as defined above to include at least one touch closure fastening means) which is wrapped around a core without overlapping itself, without overlapping another length of tape, and without being overlapped by another length of tape. The core may be formed of one or more materials, which are not necessarily suitable for forming tape, and which do not necessarily include any touch closure fastening means.

As used herein "braiding" or "braided" or "braid" refers to an article (a.k.a. device) or portion thereof having a tape (as defined above to include at least one touch closure fastening means, and as illustrated by examples herein) and in which (a) at least part of the tape overlaps itself, (b) at least part of the tape overlaps at least part of another tape, (c) at least part of the tape is overlapped by at least part of another tape, (d) at least part of the tape overlaps at least part of a strip of another material which meets the size requirements to qualify as a tape but lacks any touch closure fastening means, and/or (e) at least part of the tape is overlapped by at least part of a strip of another material which meets the size requirements to qualify as a tape but lacks any touch closure fastening means.

Figure 18:
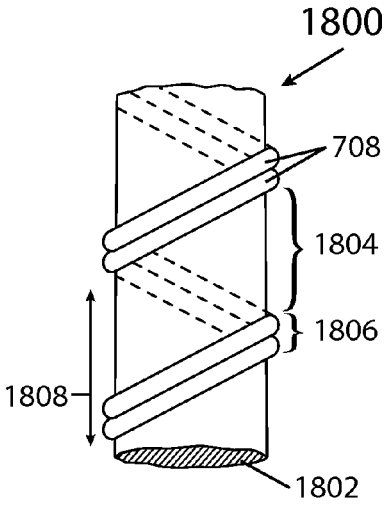
FIG. 18 is a side view illustrating embodiments of a spiraled article containing two tapes.

FIG. 18 shows a portion 1800 of a spiraled article, which in this example is an article that has two adjacent tapes 708 spiraled around a core 1802 to form a tape spiral 1806 with a spiral gap 1804 in the tape spiral 1806, and an exterior side 1808. In this example the core 1802 is substantially cylindrical with a round cross-section. In other embodiments, one or more of these features may differ, e.g., there may be one or more tapes 708, zero or more gaps between tape(s), a non-cylindrical core such as a cone-shaped core or a core with multiple components spaced apart from one another, and/or a non-round core such as a core whose cross-section is triangular, square, otherwise polygonal, ovoid, or irregularly shaped.

Figure 19:
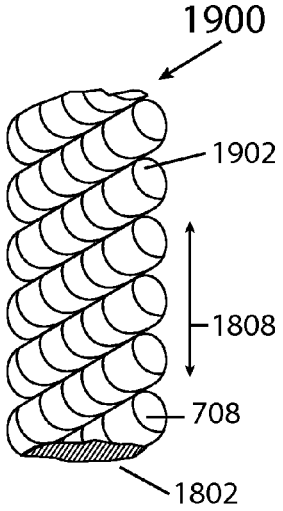
FIG. 19 is a side view illustrating embodiments of a rope article containing several tapes.

FIG. 19 shows a portion 1900 of a rope article which has tape(s) 708 spiraled and/or braided into a rope 1902 that has an exterior side 1808. One of skill will understand that individual tapes have sides, and that an article which is formed by spiraling and/or braiding one or more tapes, possibly with other non-tape material(s), also has at least one side of its own. When necessary to distinguish between them, such items can be referred to as a "tape side" as opposed to an "article side", (specifically a "braided article side" or "spiraled article side"), or vice versa, for example. When context does not dictate otherwise, "side" refers to both tape side(s) and article side(s).

Figure 20:
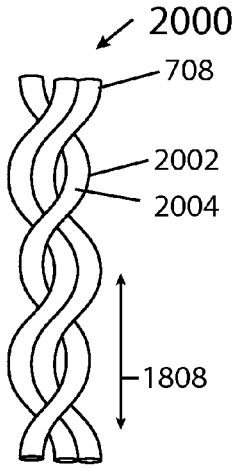
FIG. 20 is a side view illustrating embodiments of a braided multigrip article, which contains a two-laned tape braided with a grip strip.

FIG. 20 shows a portion 2000 of a braided article, which is this example is an article that has a two-laned tape 708 braided with a strip 2002 of another material which meets the size requirements to qualify as a tape but lacks any touch closure fastening means. In this example the strip 2002 bears a grip substance 2004, such as a mechanical indentation grip substance, a frictional grip substance, and/or an adhesion grip substance. Other braided article embodiments have a different number of braided elements, a different number of tape(s), have two or more grip strips 2002, and/or lack any grip strip. In FIG. 20, as in FIGS. 18, 19, 21, and 22, the tape(s) used in the braided and/or spiraled article or portion thereof may have any combination of the tape features discussed herein and/or illustrated in FIGS. 1 through 17.

Figure 21:
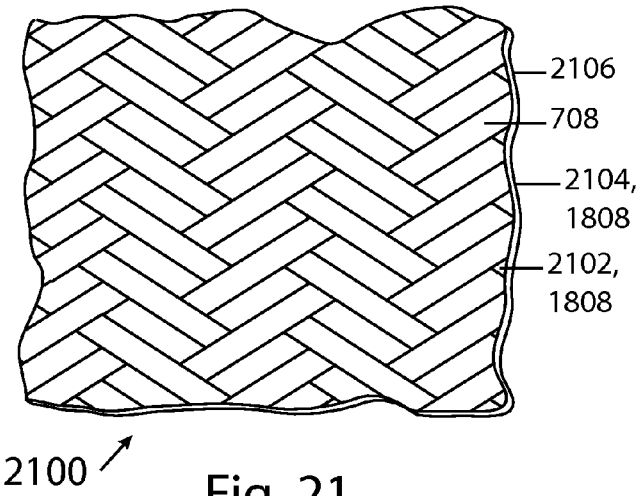
FIG. 21 is a front view illustrating embodiments of a braided article which includes a braided sheet of tape(s).

FIG. 21 shows a portion 2100 of a braided article which in this example is a braided sheet 2106 that has a tape 708 braided with other tape(s) and/or with strip(s) of material which meets the size requirements to qualify as a tape but lacks any touch closure fastening means. The sheet 2106 has a forward-facing side 2102 and a backward-facing side 2104.

Figure 22:
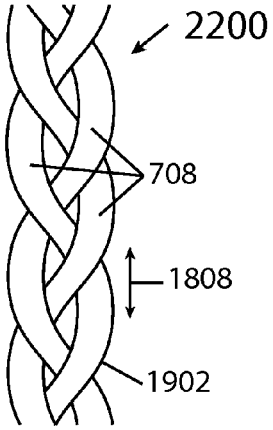
FIG. 22 is a side view illustrating embodiments of a braided rope article made by braiding three cylindrical tapes.

FIG. 22 shows a portion 2200 of a braided article which in this example is a braided rope made by braiding three cylindrical tapes 708. The rope 1902 has an exterior side 1808.

As used herein "multigripping" or "multigripped" or "multigrip" refers to an article (a.k.a. device) or portion thereof having both at least one tape and also having at least one grip to which the at least one tape is (a) braided, (b) spiraled, (c) formed integrally with, and/or (d) permanently adhered or otherwise permanently secured, e.g., clamped, stapled, or riveted. The tape can releasably fasten to itself or another tape of the article, whereas the grip helps releasable secure a work piece. A grip strip can physically connected to a tape by virtue of being spiraled around a core that the tape is also spiraled around, by virtue of being braided with the tape, or by virtue of being glued to the tape's substrate, for example.

Figure 23:
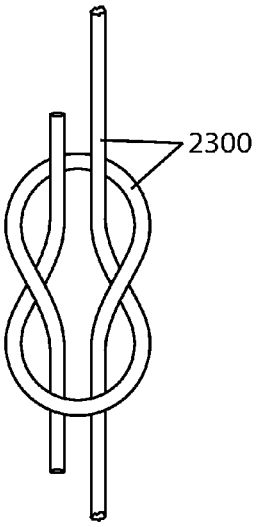
FIGS. 23 and 24 are front views illustrating a use of tapes to secure rope ends in some embodiments.
Figure 24:
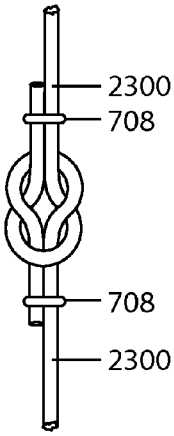
Figure 25:
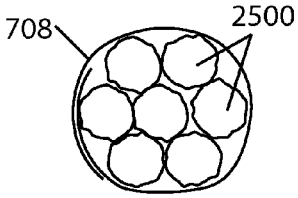
FIGS. 25 and 26 are cross-sectional views illustrating a use of tape to secure work pieces in some embodiments.
Figure 26:
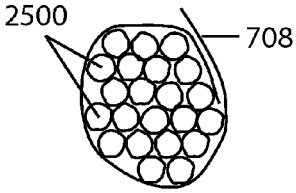
Figure 27:
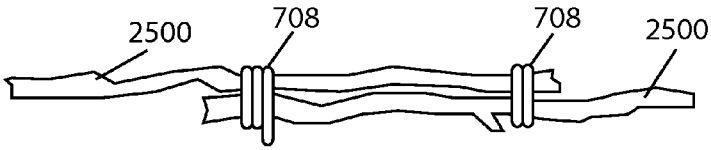
FIG. 27 is a side view illustrating a use of tape to secure work pieces in some embodiments.

FIGS. 23 through 29 illustrate a few of the many possible uses of tapes, braided articles, and spiraled articles. FIGS. 23 and 24 illustrate use of removably self-adhering tapes 708 to secure the ends of two conventional ropes 2300 (e.g., hemp or nylon ropes) which are knotted together. Cross-sectional views in FIGS. 25 and 26, and a side view in FIG. 27, each illustrate use of removably self-adhering tapes 708 to secure loads of work pieces 2500. The work pieces 2500 may be irregularly shaped, as in FIGS. 25 and 27, or they may each be similar or identical in shape to one another, as in FIG. 26.

A wide variety of work pieces 2500 can be secured in whole or in part by tapes 708 and/or by tape-built articles such as articles created by spiraling and/or braiding tape(s) 708. Some of the many examples of work pieces include pipes, logs, tubing, lumber, leather goods, textile goods, items containing plastic, items containing wood, and flesh. Some of the many examples of uses for tape 708, braided tape articles, and spiral tape articles include securing a flashlight to one's forearm, lashing goods together, medical uses noted below, tasks which might otherwise be performed using ropes knotted to themselves and/or to one another and/or to other items, tasks which might otherwise be performed using bungee cords, and tasks which might otherwise be performed using cargo covers or netting. For tasks in which tape-built articles replace or supplement conventional ropes, the tape-built articles may have dimensions similar to the conventional ropes, in terms of width or length or both. For example, some tape-built ropes are at least three meters long, and some are at least six meters long.

Figure 28:
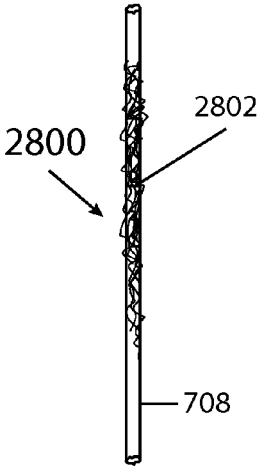
FIG. 28 is a side view illustrating embodiments of a surgical tape strand.
Figure 29:
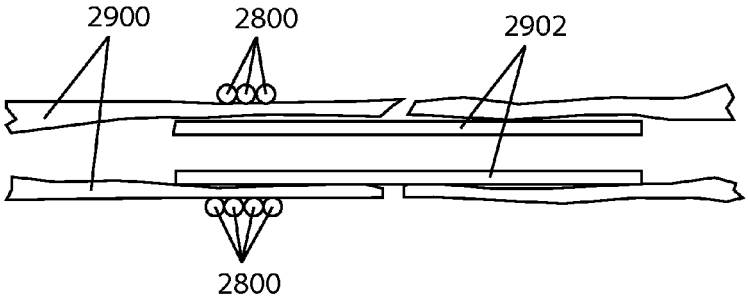
FIG. 29 is a longitudinal section view illustrating a surgical tape strand wrapped around a blood vessel according to some embodiments.

Before turning to FIGS. 28 and 29, note that nano- or micro-sized hooks, loops, and/or mat can be deposited on biosafe substrates such as materials used in sutures. Some examples of suture materials include plain catgut, chromic catgut, polyglycolide, polydioxanone, polyglactin, poliglecaprone, polytrimethylene carbonate, glycomer, nylon, polybutester, polypropylene, silk, and polyester.

U.S. Pat. No. 8,030,376 to Kurz, incorporated herein by reference in its entirety in jurisdictions permitting such incorporation, describes processes for dispersing a plurality of unaggregated particles, such as nanoparticles and microparticles, in a viscous medium. The dispersions can be used for making a variety of useful materials, such as carbon nanotube composites.

For example, one process discussed in Kurz includes: providing a nanocarrier dispersion comprising a dilute concentration of individual nanoparticles dispersed or dissolved in a nanocarrier solvent, the nanocarrier solvent characterized as being soluble in a viscous medium, the nanocarrier dispersion having a viscosity substantially lower than the viscosity of the viscous medium; contacting the nanocarrier dispersion within the viscous medium, at least a portion of the nanocarrier solvent diffusing out of the nanocarrier dispersion and into the viscous medium; and continuously removing the nanocarrier solvent from the viscous medium to give rise to a plurality of nanoparticles dispersed or dissolved in the viscous medium. Another method of dispersing particles in a viscous fluid includes: providing an particle solution comprising solvent, particles, and polymer, the particle solution being characterized as comprising well dispersed individual particles and said solvent characterized as being more soluble in water than in the viscous fluid; continuously contacting droplets of the particle solution with the viscous fluid in a droplet contact zone to form a mixture comprising the particles, the solvent, and the viscous fluid; transporting the droplets of the particle solution away from the droplet contact zone, the transported droplets being richer in solvent exterior to the droplet zone, the particles and polymer entering the viscous fluid; and contacting the viscous fluid with an aqueous phase at an interface zone located exterior to the droplet contact zone while simultaneously extracting at least a portion of the solvent out of the viscous fluid. Another method of dispersing particles in a viscous medium includes: providing an particle solution comprising a plurality of particles and a solvent, the particle solution being characterized as comprising essentially well dispersed individual particles, and said solvent characterized as being more soluble in water than in the viscous medium; contacting the particle solution with the viscous medium in a dispersion zone to form a one-phase mixture comprising the particles, the solvent, and the fluid medium; and contacting said one-phase mixture with an aqueous phase at an interface zone located exterior to the dispersion zone while simultaneously extracting at least a portion of the solvent out of the one-phase mixture and into the aqueous phase. A method of dispersing particles in an fluid medium includes: providing an particle solution comprising a plurality of particles and a solvent, the particle solution being characterized as comprising essentially well dispersed individual particles, and said solvent characterized as being more soluble in water than in the fluid medium; contacting the particle solution with the fluid medium in a dispersion zone to form a one-phase mixture comprising the particles, the solvent, and the fluid medium, said contacting occurring while simultaneously sonicating both the particle solution and the fluid medium in the dispersion zone; and contacting said one-phase mixture with an aqueous phase at an interface zone located exterior to the dispersion zone while simultaneously extracting at least a portion of the solvent out of the one-phase mixture and into the aqueous phase.

More generally, familiar processes for creating nanohooks, nanosized mushroom heads, nanoloops, and/or nanomat can be combined with familiar processes for depositing nanotubes on material which is safe for a patient if left inside after surgery, or familiar processes for forming such nano features on such safe materials, or with familiar processes for adhering a touch closure fastening means to a substrate. As a result, one can obtain surgical grade tape strands which self-adhere in a releasable manner.

FIG. 28 illustrates one such surgical tape strand portion 2800 having microblended nano-sized hooks and mat touch closure fastening means 2802. Surgical tape strands may be used by surgeons as retractive ties to temporarily hold blood vessel, nerves, or other tissue aside to provide better access to a surgical area, for example, and for doing so without crowding the surgical field with conventional retractors and clamps. They may also be used as temporary clamps or ligatures, or as sutures which have the advantage of avoiding some or all of the tissue puncturing that might otherwise occur, because the surgical tape strands releasably self-adhere. The longitudinal section view of FIG. 29 shows a surgical tape strand 2800 wrapped around a blood vessel 2900 to help hold a stent 2902 in place. Some surgical tape strand embodiments are roughly the diameter of suture material, while others are larger.

Some embodiments address technical problems evident in or created by work piece slippage or load shifting, by providing tapes 708 which not only releasably adhere to themselves or another constituent tape of a braided or spiraled article, but also restrict or inhibit slippage and shifting by pressing one or more grips 1402 against the work pieces 2500 or other parts of a load.

Some embodiments address technical problems evident in or created by odd or varying load sizes, by providing tapes 708 and tape articles which self-adhere along their length. Bungee cords, tarps, and ratchet straps each presume a particular load size and shape, whereas tape ropes 1900, for example, are much more flexible in accommodating odd or varying load sizes and shapes. Like conventional ropes, tape ropes can be snugged against a load in a manner limited to a large extent only by rope length, but unlike conventional ropes, tape ropes can be fastened without knots, and some of them—those including grips—also help hold the cargo from slipping or sliding. Problems caused by knot complexity or knot bulk are avoided by using a tape rope's touch closure fastening means instead of tying knots, in situations where that is safe and effective. If a load can be scratched or indented or punctured, then tape rope including a corresponding grip can be used to help secure the load. For example, framing lumber and firewood can be scratched without harming them, so an abrasive grip embedded in a tape rope can be used. Carpets can be punctured without harming them, so a spike grip embedded in a tape rope can be used to help secure them.

Tape ropes made with materials suitable for marine use, such as polypropylene, nylon, and Kevlar® para-aramid synthetic fiber material (mark of E. I. DuPont de Nemours and Company), can be enhanced as taught herein with embedded touch closure fastening means and/or grips.

CONCLUSION

Although particular embodiments are expressly illustrated and described herein as devices, or processes for using devices, it will be appreciated that discussion of one type of embodiment also generally extends to other embodiment types. For instance, the descriptions of fastening devices also help describe processes for using such devices, and vice versa. It does not follow that limitations from one embodiment are necessarily read into another.

Reference herein to an embodiment having some feature X and reference elsewhere herein to an embodiment having some feature Y does not exclude from this disclosure embodiments which have both feature X and feature Y, unless such exclusion is expressly stated herein. The term "embodiment" is merely used herein as a more convenient form of "device, process, system, article of manufacture, and/or other example of the teachings herein as applied in a manner consistent with applicable law." Accordingly, a given "embodiment" may include any combination of features disclosed herein, provided the embodiment is consistent with at least one claim.

Not every item or feature shown in the Figures need be present in every embodiment. Conversely, an embodiment may contain item(s) and/or feature(s) not shown expressly in the Figures. Although some possibilities are illustrated here in text and drawings by specific examples, embodiments may depart from these examples. For instance, specific technical effects or technical features of an example may be omitted, renamed, grouped differently, arranged differently, repeated, instantiated in different materials, or be a mix of effects or features appearing in two or more of the examples. Functionality shown at one location may also be provided at a different location in some embodiments; one of skill recognizes that functionality can be obtained in various ways in a given situation without necessarily omitting desired technical effects from a collection of interacting devices and other items viewed as a whole.

Reference has been made to the figures throughout by reference numerals. Any apparent inconsistencies in the phrasing associated with a given reference numeral, in the figures or in the text, should be understood as simply broadening the scope of what is referenced by that numeral. Different instances of a given reference numeral may refer to different embodiments, even though the same reference numeral is used.

As used herein, terms such as "a" and "the" are inclusive of one or more of the indicated item or step. In particular, in the claims a reference to an item generally means at least one such item is present and a reference to a step means at least one instance of the step is performed.

Headings are for convenience only; information on a given topic may be found outside the section whose heading indicates that topic.

All claims and the abstract, as filed, are part of the specification.

While exemplary embodiments have been shown in the drawings and described above, it will be apparent to those of ordinary skill in the art that numerous modifications can be made without departing from the principles and concepts set forth in the claims, and that such modifications need not encompass an entire abstract concept. Although the subject matter is described in language specific to structural features and/or procedural acts, it is to be understood that the subject matter defined in the appended claims is not necessarily limited to the specific technical features or acts described above the claims. It is not necessary for every means or aspect or technical effect identified in a given definition or example to be present or to be utilized in every embodiment. Rather, the specific features and acts and effects described are disclosed as examples for consideration when implementing the claims.

All changes which fall short of enveloping an entire abstract idea but come within the meaning and range of equivalency of the claims are to be embraced within their scope to the full extent permitted by law.

What is claimed is:

1. A tape-built article comprising:

at least two tapes, each tape comprising a tape substrate and a touch closure fastening means;

each tape substrate having at least one side, each tape substrate having a length-to-width ratio of at least three;

each touch closure fastening means being physically connected to at least one respective tape substrate; wherein at least one of the tapes has at least two lanes;

at least one of the tapes comprises a grip; and wherein at least two of the tapes are braided with one another.

2. The tape-built article of claim 1, wherein each of at least two tapes has a respective touch closure fastening means that is different from the touch closure fastening means of at least one other of the tapes.

3. The tape-built article of claim 1, wherein the grip comprises an adhesion grip.

4. The tape-built article of claim 1, wherein at least one of the tape substrates comprises a woven fabric.

5. The tape-built article of claim 1, wherein at least one of the tapes has a length-to-width ratio of at least ten.

6. The tape-built article of claim 1, wherein at least one of the touch closure fastening means is adhered to the respective tape substrate.

7. The tape-built article of claim 1, wherein at least one of the tape substrates comprises at least one suture material.

8. The tape-built article of claim 1, wherein at least one of the touch closure fastening means comprises at least one of the following: hooks, mushroom heads, loops, or a mat.

9. The tape-built article of claim 1, wherein at least one of the touch closure fastening means comprises nanofibers.

10. The tape-built article of claim 1, wherein the grip comprises an abrasive grip substance.

11. A tape-built article comprising:

at least two tapes, each tape comprising a tape substrate and a touch closure fastening means;

each tape substrate having at least one side, each tape substrate having a length-to-width ratio of at least three;

each touch closure fastening means being physically connected to at least one respective tape substrate;

wherein at least one of the tapes has at least two lanes;

at least one of the tapes comprises a grip; and wherein at least one of the touch closure fastening means comprises at least a mottled portion which is formed with two or more of the following: hooks, loops, mat, microfiber, nanofiber, or mushroom heads.

12. A tape-built article comprising:

at least one tape, the tape comprising a tape substrate and a touch closure fastening means;

the tape substrate having at least one side, the tape substrate having a length-to-width ratio of at least five;

the touch closure fastening means being physically connected to the tape substrate; and at least one grip strip which is physically connected to the tape; and wherein the touch closure fastening means comprises at least a mottled portion which is formed with two or more of the following: hooks, loops, mat, microfiber, nanofiber, or mushroom heads.

13. A tape-built article comprising:

at least one tape, the tape comprising a tape substrate and a touch closure fastening means;

the tape substrate having at least one side, the tape substrate having a length-to-width ratio of at least five;

the touch closure fastening means being physically connected to the tape substrate; and at least one grip strip which is physically connected to the tape; and wherein the tape and the grip strip are physically connected in that they are braided with one another.

* * * * *